United States Patent [19]

Bächtiger

[11] 4,375,107

[45] Mar. 1, 1983

[54] COLLAR FOR AN ARTICLE OF CLOTHING

[75] Inventor: Urs Bächtiger, Zurich, Switzerland

[73] Assignee: Gygli Technik AG., Switzerland

[21] Appl. No.: 200,502

[22] PCT Filed: Dec. 18, 1979

[86] PCT No.: PCT/CH79/00162

§ 371 Date: Aug. 22, 1980

§ 102(e) Date: Aug. 20, 1980

[87] PCT Pub. No.: WO80/01233

PCT Pub. Date: Jun. 26, 1980

[30] Foreign Application Priority Data

Dec. 22, 1978 [CH] Switzerland ..... 13137/78
Oct. 18, 1979 [CH] Switzerland ..... 9368/79

[51] Int. Cl.[3] ..... A41B 3/04

[52] U.S. Cl. ..... 2/131; 2/139; 2/143

[58] Field of Search ..... 2/129, 131, 139, 140, 2/143

[56] References Cited

U.S. PATENT DOCUMENTS

| | | | |
|---|---|---|---|
| 1,521,152 | 12/1924 | Hess | 2/131 |
| 1,787,113 | 12/1930 | Larson | 2/131 X |
| 1,851,222 | 3/1932 | Turpan | 2/131 |
| 1,994,600 | 3/1935 | Weinstein | 2/131 |
| 2,152,094 | 3/1939 | Rubinstein | 2/131 |
| 2,186,387 | 1/1940 | Metzger | 2/131 |
| 4,040,125 | 8/1977 | Blue | 2/139 |

FOREIGN PATENT DOCUMENTS

| | | | |
|---|---|---|---|
| 1050613 | 1/1954 | France | 2/131 |
| 443126 | 2/1936 | United Kingdom | 2/131 |
| 1512859 | 6/1978 | United Kingdom | 2/143 |

*Primary Examiner*—Louis Rimrodt
*Attorney, Agent, or Firm*—Pennie & Edmonds

[57] ABSTRACT

A turn-over area having two folds is formed in a part constituted by a collar outside and an insert and is held together by seams. Fold formation is facilitated by making the insert in the turn-over area in which the strip, which is usually adhered to the collar outside has unstiffened strips in the area of the folds and another strip for the turn-over area. The first-mentioned strips can be replaced by cuts or perforations. The portion formed in this way can be pre-sewn, turned and stitched to the collar underside, in the same way as a one-piece collar. Despite the fact that the working and material expenditure is only a little greater than in a one-piece collar, the appearance is that of a two-piece collar, which is taken as an indication of the quality of the article of clothing.

8 Claims, 12 Drawing Figures

COLLAR FOR AN ARTICLE OF CLOTHING

The invention relates to a collar for an article of clothing, particularly a shirt or a blouse, having an upper collar and a neck band and which is formed by an upper material with a collar outside and underside, as well as insert, whereby at least the upper material is made from a piece of textile material.

It is known to make collars for articles of clothing in the form of two-piece collars in which an upper collar and a neck band are made separately and then sewn together. The lower edge of the upper collar and the upper edge of the neck band can be given a different curvature, so that the upper collar and the neck band attain a particularly desired shaping on wearing. As a result, the upper collar and the neck band engage closely on one another in the neck, but outwardly directed collar tips are still obtained.

Due to the expenditure involved in the manufacture of two-piece collars, great efforts have been made to reduce the manufacturing expenditure. This has led to the development of the known one-piece collar, particularly in conjunction with the development of inserts connected to the upper material by means of thermoplastic adhesive, that is to say the upper material, i.e. the collar outside and underside, together with the insert for producing the upper collar and the neck band from in each case a single piece of textile material. Although this led to a noticable reduction in manufacturing costs it made it impossible to achieve the preferred shaping of two-piece collars, particularly the shaping of the collar points. Thus, compared with two-piece collars produced with a loose or adherable insert, one-piece collars have an easily detectable inferior quality, which has an unfavourable effect on the price.

The problem of the invention is to provide a collar of the type described hereinbefore, i.e. a one-piece collar in such a way that it has the appearance and characteristics of the two-piece collar.

According to the invention, this problem is solved in that at least the insert has in the turn-over area between the upper collar and the neck band an upper collar-side first fold and a neck band-side oppositely directed second fold, the folds being held together by at least one seam.

As a result, the collar according to the invention can be produced with the same manufacturing costs as the one-piece collar and only a small amount of extra material is required for the insert and possibily the upper material.

Figure 1:
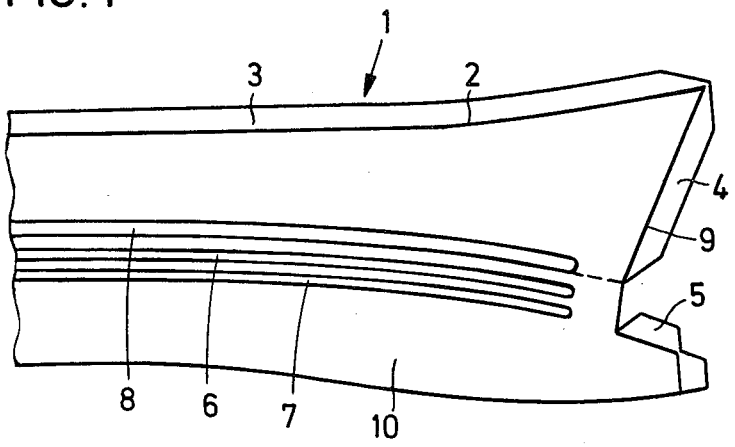

The invention is described in greater detail hereinafter relative to non-limitative embodiments and the attached drawings, wherein show:

FIG. 1 of a partly represented insert for a collar.

Figure 2:
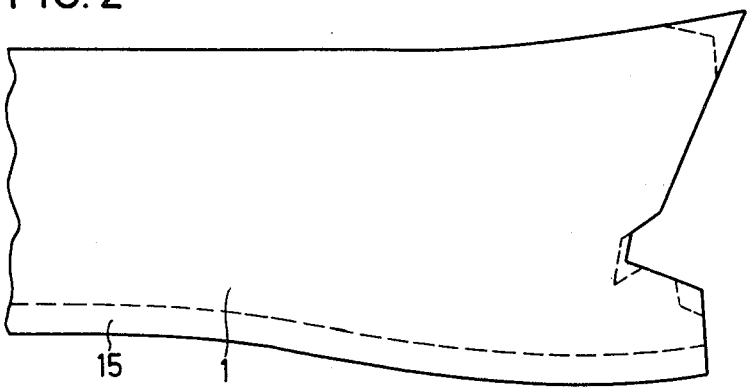

FIG. 2 a view of the upper material of a partly shown collar outside.

Figure 3:
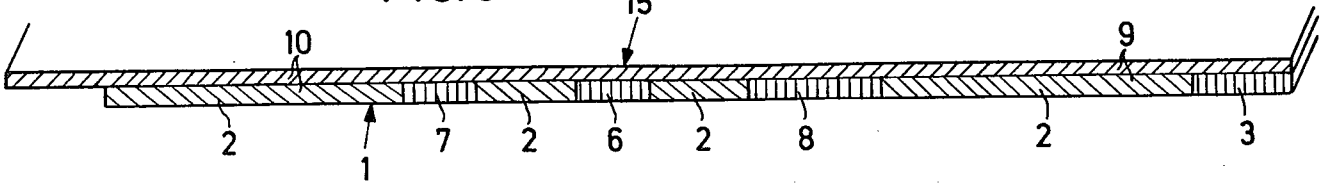
Figure 4:
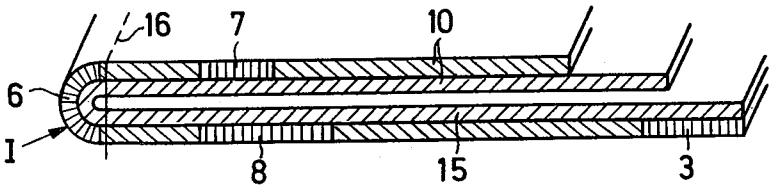
Figure 5:
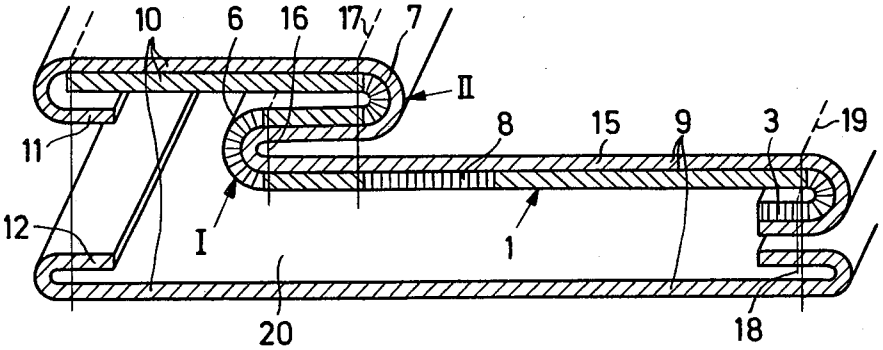

FIGS. 3 to 5 a three-dimensional view of the production of a collar in which FIG. 3 is the upper material of an unfolded collar outside and a partly stiffened insert struck thereto, FIG. 4 the formation of the first fold in the upper material of the collar outside and in the insert and FIG. 5 the turned collar after forming the second fold and sewing to the upper material of a collar underside.

Figure 6:
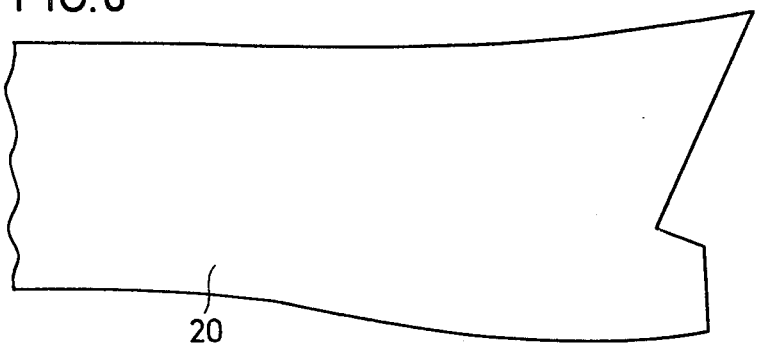

FIG. 6 a view of the upper material of a partly shown collar underside.

Figure 7:
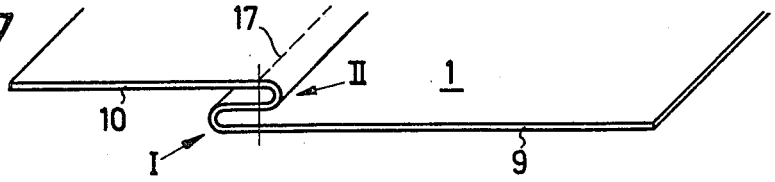

FIG. 7 a three-dimensional view of an insert for a collar whilst forming two folds.

Figure 8:
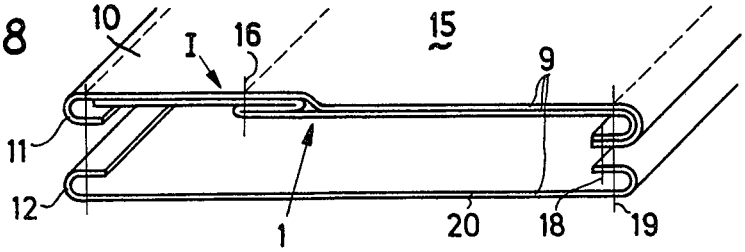

FIG. 8 a three-dimensional view of a collar, like FIG. 5, but with a flat unfolded upper material of the collar outside.

Figure 9:
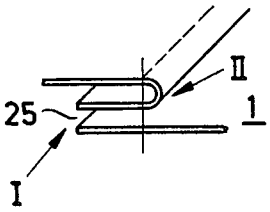

FIG. 9 a three-dimensional view of the fold or turn-over area of an insert according to FIG. 7 with a cut fold.

Figure 10:
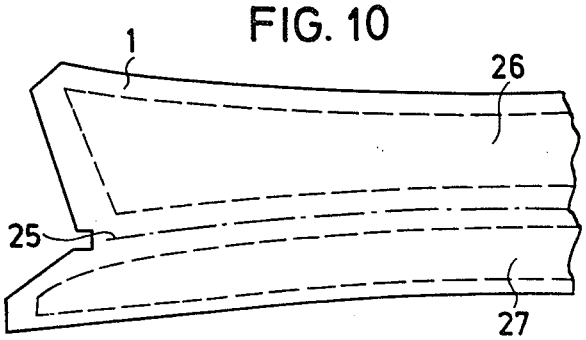

FIG. 10 a view of a partly shown insert with a perforation in the fold or turn-over area.

Figure 11:
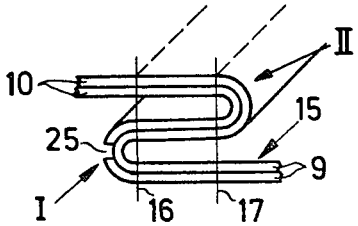

FIG. 11 a three-dimensional view of the fold or turn-over area of the upper material of a collar outside and an insert adhered thereto, similar to FIG. 5, but with the insert perforated in a fold.

Figure 12:
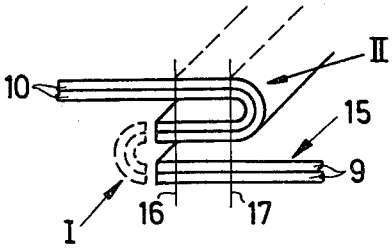

FIG. 12 a view of the fold or turn-over area, as in FIG. 11, but with a cut fold.

The collar according to the invention is made from an insert 1, which has stiffened portions and unstiffened, i.e. soft portions. The insert 1 shown in FIG. 1 has a stiffened portion 2 and soft, unstiffened portions. These unstiffed, soft portions, are seam additions 3, 4, 5 and three strips 6, 7, 8 which extend virtually over the entire length of insert 1. Strips 6, 7, 8 form areas in which in each case a fold is formed on shaping the collar. Strip 8 forms the turn-over area, i.e. the fold between the externally visible upper collar 9 and the inner neck band 10.

Insert 1 is connected, e.g. adhered to the collar outside 15 shown in FIG. 2. The contour of insert 1 is indicated by dotted lines, where it does not coincide with that of the collar outside 15.

The formation of the collar which has the appearance of a two-piece collar, is explained relative to FIGS. 3 to 5. FIG. 3 is a section through the collar outside 15 adhered to insert 1. A first fold I is formed by the portion covered by the central strip 6, of FIG. 4, in which the collar outside 15 is on the inside and the fold I is sewn together by a seam 16. For ease of viewing, fold I and also the folds shown in FIG. 5 are indicated as a curved portion. In reality, the two parts of the collar outside 15 are superimposed and the fold I and the remaining folds form relatively sharp edges.

According to FIG. 5, the portion forming the neck band 2 at strips 7 is folded, so that a fold II is formed sewn together with the two parts of fold I by a seam 17.

Through the formation of folds I and II and their fixing by the two seams 16, 17 the preparations for forming a one-piece collar which looks like a two-piece collar are ended. The thus shaped collar outside 15 is now sewn together with the upper material of a collar underside 20, shown in FIG. 6. As the collar outside 15 forms a portion comprising three layers and the two folds I and II, the smooth collar underside 20 can have a corresponding smaller width. The collar underside 20 is now pre-sewn by a seam 18 to the collar outside 15, as in the case of a normal one-piece collar and then the collar is turned. The collar outside 15 and collar underside 20 are now positioned on the outside and the seam 17 on the inside, of FIG. 5. Optionally, the edge of upper collar 9 can be provided with a further seam 19. The seam additions 11, 12 provided on the edges of neck band 10 are sewn in the manner indicated in FIG. 5 to the article of clothing, e.g. to a shirt or blouse. The turn-over area can now be formed in that the upper collar 9 is folded along strip 8 with respect to neck band 10

Much less work is required with this collar than with a two piece collar. The collar comprises only three parts and can therefore be produced in the same way as a one-piece collar if folds I and II are formed, so that in the collar along the turn-over area there is no crinkling of the seam. Due to the different lengths of strips 6, 7 and 8 there is a discontinuity, i.e. a shape which is otherwise only obtained in the case of two-piece collars with different curvature of the upper collar and the neck band.

The insert 1 can be produced in a random manner, e.g. with a stiffened impression or by sticking on an additional insert portion. The strips 6 and 7 can also be punched. The strip 8 forming the turn-over area can optionally also be stiffened or punched.

Further simplifications in the production of the collar are shown in FIGS. 7 to 12. The one-piece insert 1 shown in FIG. 1 in not shown manner is either treated with a stiffening agent or is provided with stiffening means. Between the upper collar 9 and the neck band 10, an upper collar-side first fold I and a neck band-side, oppositely directed second fold II is formed. The second fold II is sewn to the upper collar 9 by a seam 17.

During further processing, the insert 1 is firstly stuck to the collar outside 15 and then the collar underside 20 is pre-sewn in known manner by seam 18 and the collar is then turned, of FIG. 8. The edge of upper collar 9 can also be provided with slot 19 and the upper material additions 11, 12 on neck band 10 can be sewn together with a not shown article of clothing. The area of fold I can be sewn together with the further seam 16.

FIG. 9 shows the fold or turn-over area of FIG. 1. However, fold I is provided with a perforation 25, of FIG. 10. The position of fold I is determined by perforation 25, of FIG. 11 and simultaneously the formation of the fold or turn-over area between upper collar 9 and neck band 10 is facilitated.

Perforation 25 can be replaced by a through-cut at the same point of insert 1.

Perforation 25 can also be provided in an insert in which the insert is stiffened by corresponding stiffening portions 26, 27. For the production of the collar according to the invention, it is unimportant how insert 1 is made.

If the formation of the collar fold or turn-over area takes place after sticking the insert 1 to the collar outside 15, perforation 25 can also be provided in insert 1 to reduce wear to the folds, of FIG. 11. An even greater reduction of wear is attained according to FIG. 12, where perforation 25 is replaced by cutting of fold I, so that its edge is removed.

As stated hereinbefore, a little more textile material is required in the collar of FIG. 5 for forming the fold or turn-over area, both for insert 1 and for the upper material of the collar outside 15 and with one-piece collars. However, with the collar of FIG. 8, the material requirement is still lower, because additional material for fold formation is only required for insert 1. It is also possible to provide insert 1 with unstiffened, soft strips 6, 7, 8 according to FIG. 1, so that the formation of the folds is facilitated.

With the formation of folds I and II, it is possible to vary the design of insert 1 in a virtually random manner and provide it with stiffening portions or additional stiffening areas, as well as with narrow or wide cuts in the area of folds I and II. Thus, the unstiffened strips 6 and 7 provided in FIG. 1 for the formation of folds I and II can be replaced by two cuts or a single cut. In the latter case, folds I and II are located on the edges of said cut. The actual turn-over line corresponding to strip 8 can be formed e.g. by the edge of an additional stiffening part, as in FIG. 10, An additional stiffening part can also be provided in the neck band only. Finally, when using special sewing machines, there is no need for a special design of the insert with recesses, unstiffened portions or other sewing aids. It is then even possible to work loose inserts not stuck to the upper material.

I claim:

1. In a collar for an article of clothing, such as a skirt or blouse, including a turn down portion and a neck band portion separated by a collar fold line, and being formed of a one-piece outer fabric member, a one-piece inner fabric member and an insert between the fabric members, the improvement comprising an interrupting portion in said inset corresponding to said collar fold line;

said outer fabric member and said insert forming, on one side of said collar fold line, a first fold directed toward said turn down portion and a second fold oppositely directed toward said neck band portion, the path of said first and second folds following said interrupting portion; and at least one seam holding said folds together.

2. A collar according to claim 1 wherein said insert is cut at said first fold.

3. A collar according to claim 1 wherein said insert is perforated at said first fold.

4. A collar according to claim 1 wherein said insert has soft strips at said folds and fold line.

5. A collar according to claim 1 wherein said insert has unstiffened strips at said folds and fold line and is stiffened throughout substantially the remainder thereof.

6. A collar according to claim 1 wherein said insert has punched strips at said folds and fold line.

7. A collar according to claim 1 wherein said insert has three unstiffened strips with a central one of said strips at said first fold, with said strip adjacent said neck band portion at said second fold and with said strip adjacent said turn down portion at said collar fold line.

8. A collar according to claim 1 wherein said insert is adhered to said outer fabric member.

* * * * *